US006974924B2

(12) United States Patent
Agnatovech et al.

(10) Patent No.: US 6,974,924 B2
(45) Date of Patent: Dec. 13, 2005

(54) ILLUMINATED PUSHBUTTON SWITCH

(75) Inventors: William Joseph Agnatovech, Hudson, MA (US); Frank Mark Domzalski, Wellesley, MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 102 days.

(21) Appl. No.: 10/817,031

(22) Filed: Apr. 1, 2004

(65) Prior Publication Data

US 2005/0224327 A1 Oct. 13, 2005

(51) Int. Cl.[7] ..... H01H 9/00
(52) U.S. Cl. ..... 200/314; 200/341
(58) Field of Search ..... 200/310–316, 200/341, 16 B, 520–524, 529–531, 252, 200/257, 275

(56) References Cited

U.S. PATENT DOCUMENTS

| | | | | | |
|---|---|---|---|---|---|
| 3,165,612 | A | * | 1/1965 | Bailey | 200/526 |
| 3,437,775 | A | * | 4/1969 | Piber | 200/314 |
| 3,522,402 | A | | 8/1970 | Di Pilla | 200/167 |
| 3,746,157 | A | | 7/1973 | I'Anson | 206/46 |
| 3,927,290 | A | * | 12/1975 | Denley | 200/314 |
| 4,013,855 | A | * | 3/1977 | Reichen et al. | 200/314 |
| 4,016,561 | A | | 4/1977 | Parker et al. | 340/384 |
| 4,629,266 | A | | 12/1986 | Viselli | 339/17 |
| 4,918,513 | A | | 4/1990 | Kurose et al. | 357/74 |
| 4,933,523 | A | | 6/1990 | Honda et al. | 200/526 |
| 5,220,274 | A | | 6/1993 | Nightingale et al. | 324/72.5 |
| 5,579,903 | A | | 12/1996 | McEvilly et al. | 200/524 |
| 5,641,952 | A | * | 6/1997 | Collings | 200/11 R |
| 5,823,326 | A | * | 10/1998 | Saito et al. | 200/524 |
| 5,878,870 | A | * | 3/1999 | Ohtaki | 200/314 |
| 6,454,572 | B1 | | 9/2002 | Konetski et al. | 439/66 |

* cited by examiner

*Primary Examiner*—Elvin G. Enad
*Assistant Examiner*—Lisa Klaus
(74) *Attorney, Agent, or Firm*—Roger C. Turner

(57) ABSTRACT

A low cost miniature illuminated pushbutton switch 10 for soldering to a circuit board (23), which avoids damage to an LED during such soldering to the board. The pushbutton assembly, which slides between outward and inward positions, includes a molded plastic frame (32), sheet metal pushbutton conductors (60, 62, 64) mounted on the frame, and an LED (36) having a bulb (74) lying forward of the frame and having leads (40, 42) joined to front ends of two of the pushbutton conductors. The pushbutton assembly also has a pushbutton depressing element (44) with a through passage (130) that surrounds the bulb and extends forward of the bulb, the pushbutton element having an inward end (132) that joins to the pushbutton frame through lugs (136). A pair of the sheet metal conductors (60, 62) have inward ends exposed to deflectable housing contact portions (96, 98), the sheet metal conductors have middle portions that extend through the frame, and the sheet metal conductors have outer ends forming crimp barrels (70, 72) that are crimped to the leads.

10 Claims, 4 Drawing Sheets

ILLUMINATED PUSHBUTTON SWITCH

BACKGROUND OF THE INVENTION

Miniature pushbutton switches, which are commonly soldered to circuit boards, often work in conjunction with illumination sources such as a light pipe to illuminate the depressable portion of the pushbutton. The light pipes generally cannot withstand the temperatures (e.g. 250 C) used in reflow soldering. Other light sources such as LEDs (light emitting diodes) also can be damaged by such high temperatures used in soldering. A low cost miniature illuminated switch that could be soldered to a circuit board by reflow soldering, without requiring any further operation, would be of value.

SUMMARY OF THE INVENTION

In accordance with one embodiment of the present invention, an illuminated pushbutton switch is provided that is rugged and of low cost, and which can be readily soldered to a circuit board by reflow soldering. The switch includes a housing and a pushbutton assembly that is slideable in inward and outward directions on the housing. The pushbutton assembly includes a molded plastic frame and a plurality of conductors mounted on the frame, to be engaged by deflectable housing contacts that have termination ends to be soldered to the circuit board. An LED mounted on the frame, has a pair of leads connected to a pair of the conductors. The LED is surrounded by a dielectric pushbutton element that has an inner end fixed to the frame and an outer end lying forward of the LED, the pushbutton element providing heat isolation to protect the LED from excessive heating during reflow soldering.

The conductors mounted on the pushbutton frame, are formed of sheet metal. Inner ends of the pair of conductors that are connected to the LED leads, form crimp barrels that are crimped to the leads, to avoid loosening during reflow soldering. The pushbutton frame has a wide inner portion forming a contacting surface on which the conductors are mounted. The pushbutton frame has a narrower outward extension through which the pair of sheet metal conductors extend, the extension closely receiving and latching to the pushbutton element.

The housing includes a molded plastic insulated bottom portion, and a sheet metal cover that is crimped to the bottom portion.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
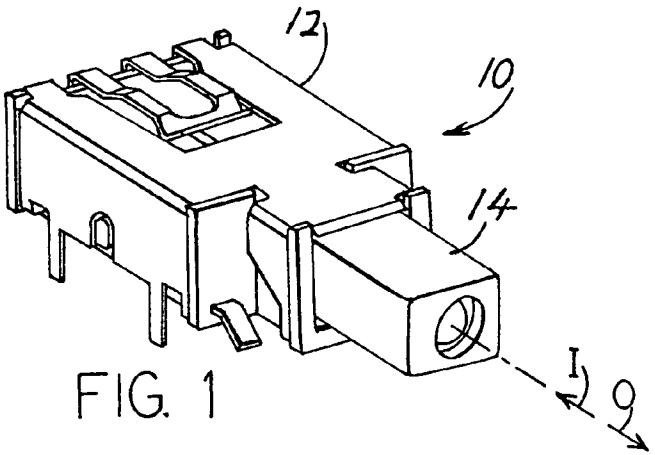
FIG. 1 is an isometric view of an illuminated switch constructed in accordance with the present invention.
Figure 3:
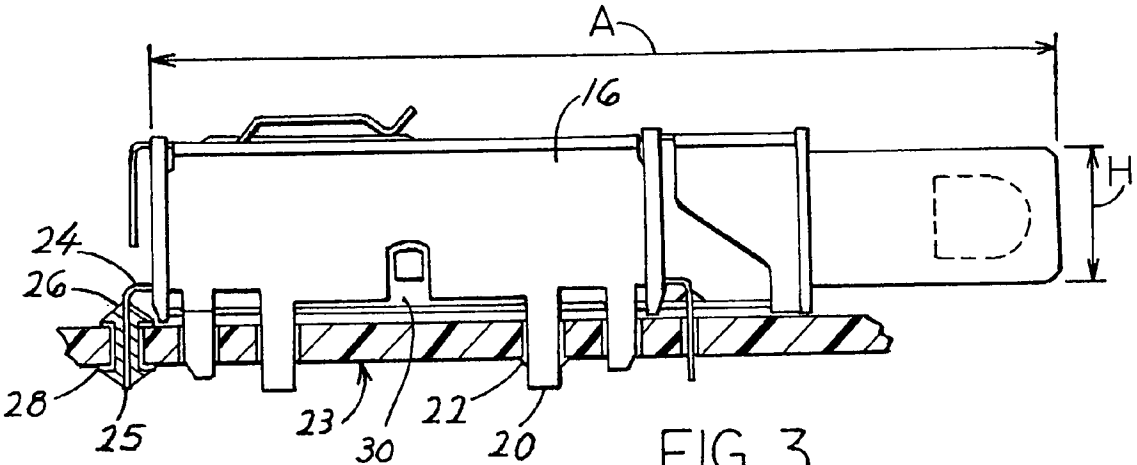
FIG. 3 is a side elevation view of the switch of FIG. 1, shown mounted on and soldered to a circuit board.
Figure 4:
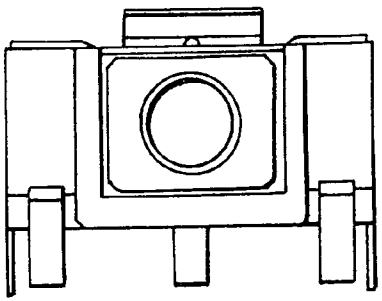
FIG. 4 is an outer end view of the switch of FIG. 1.

FIG. 1 illustrates an illuminated miniature pushbutton switch 10 of a type that is designed to be mounted on a circuit board. The switch includes a stationary housing 12 and a pushbutton assembly 14 that can slide in inward I and outward O directions on the housing. As shown in FIG. 3, the housing has a grounded sheet metal cover 16 that has terminals 20 that are soldered by solder joints 22 to grounded traces on the circuit board 23. Housing switch contacts 24 are mounted on an insulated main portion 30 of the housing and have terminal ends 25 that are soldered by solder joints 26 to signal traces such as 28 on the circuit board. The sheet metal cover is attached to the housing main portion by crimping the cover as at tabs 25, 27.

Figure 5:
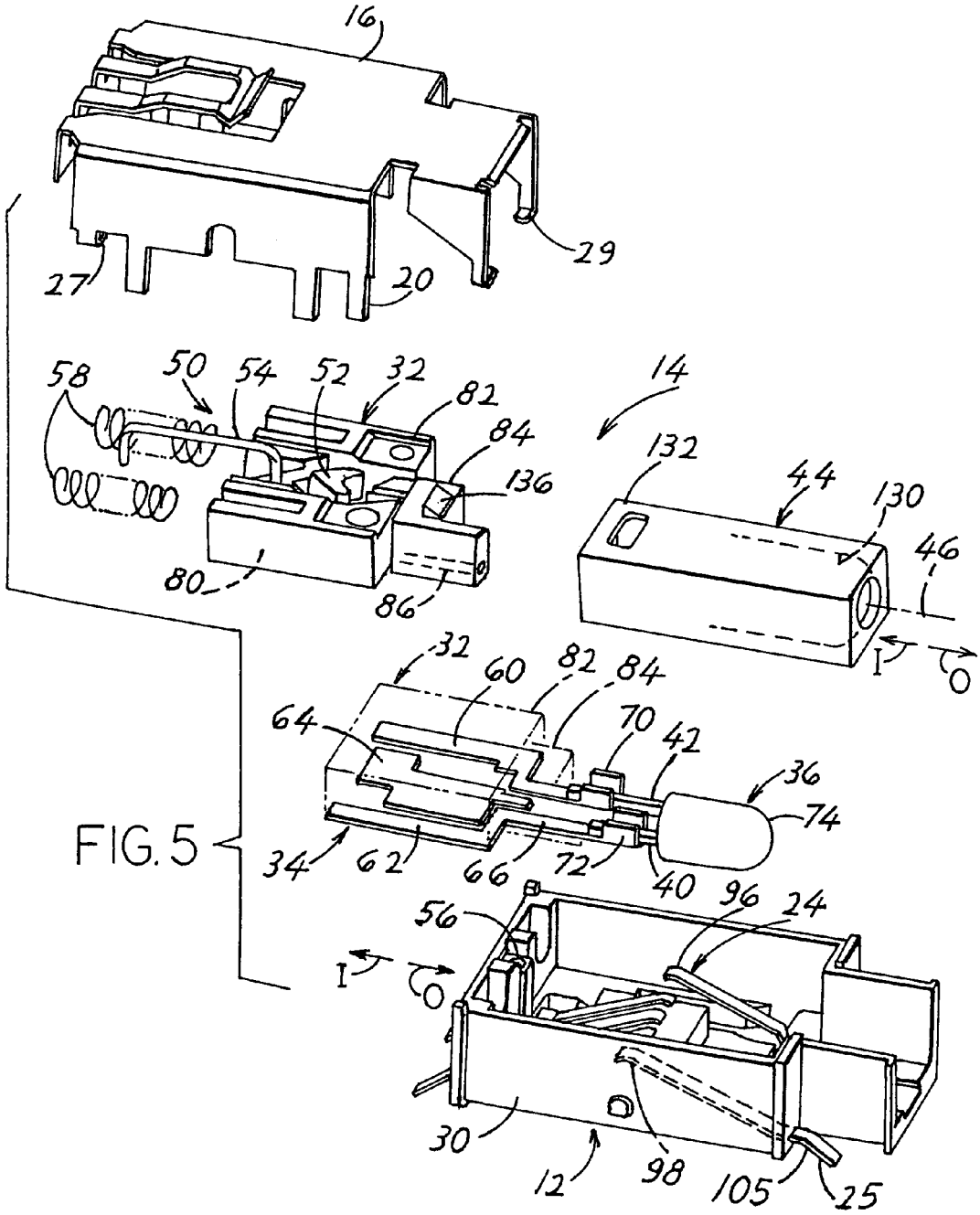
FIG. 5 is an exploded isometric view of the switch of FIG. 1.

FIG. 5 shows that the housing 12 includes an insulated portion 30 on which the housing switch contacts 24 are mounted, in addition to the grounded sheet metal cover 16. The pushbutton assembly 14 includes a molded plastic dielectric (electrically insulative) pushbutton frame 32, a plurality of pushbutton conductors 34, and an LED light source 36 with leads 40, 42 that are connected to two of the pushbutton conductors. The pushbutton assembly also includes a pushbutton depressing element 44 that is manually depressed in the inward direction I along its axis 46. When the depressing element is in its outward position and is depressed inward, a double click mechanism 50 retains the element in its inward position. When the element is depressed again, the double click mechanism releases the element to move outward to its outward position. The double click mechanism includes a cam 52 molded into the pushbutton frame and a cam follower 54 that has an inward end pivotally mounted in a hole 56 of the housing. A pair of springs 58 bias the pushbutton assembly outward O.

The pushbutton conductors 34 are all formed of sheet metal. Two of the pushbutton conductors 60, 62 are lead conductors that are dedicated to carrying electricity to the lead of the LED light source 36. An additional sheet metal pushbutton conductor 64 provides switching functions. The two lead conductors 60,62 have inward ends that form crimp portions, or crimp barrels 70,72 that are crimped around the LED leads. The crimp barrels lie outward of the frame 32 and are bent around axes that are parallel to axis 46. The bulb 74 (a clear plastic member that encapsulates a diode) of the LED extends outward of the leads. Inward portions of the three pushbutton conductors lie on a contacting surface 80 of an inward portion 82 of the dielectric pushbutton frame. The frame also has an outward extension 84. The lead conductors 60, 62 have portions 66 that extend though the frame extension, with the crimp barrels 70,72 lying outward of the frame extension. The conductors 60–64 can be bonded as by adhesive to the contacting surface 80 of the frame inward portion.

The inward portion 82 (FIG. 8) of the pushbutton frame has a small thickness or height T. The outward extension 84 of the frame has less than half the width of the inward portion, and is downwardly offset. This allows the pressing element top to lie about flush with the top of the frame inward portion. An empty volume is left under the contacting surface 80 of the frame inward portion, which is occupied by the deflectable housing contact portions.

Figure 6:
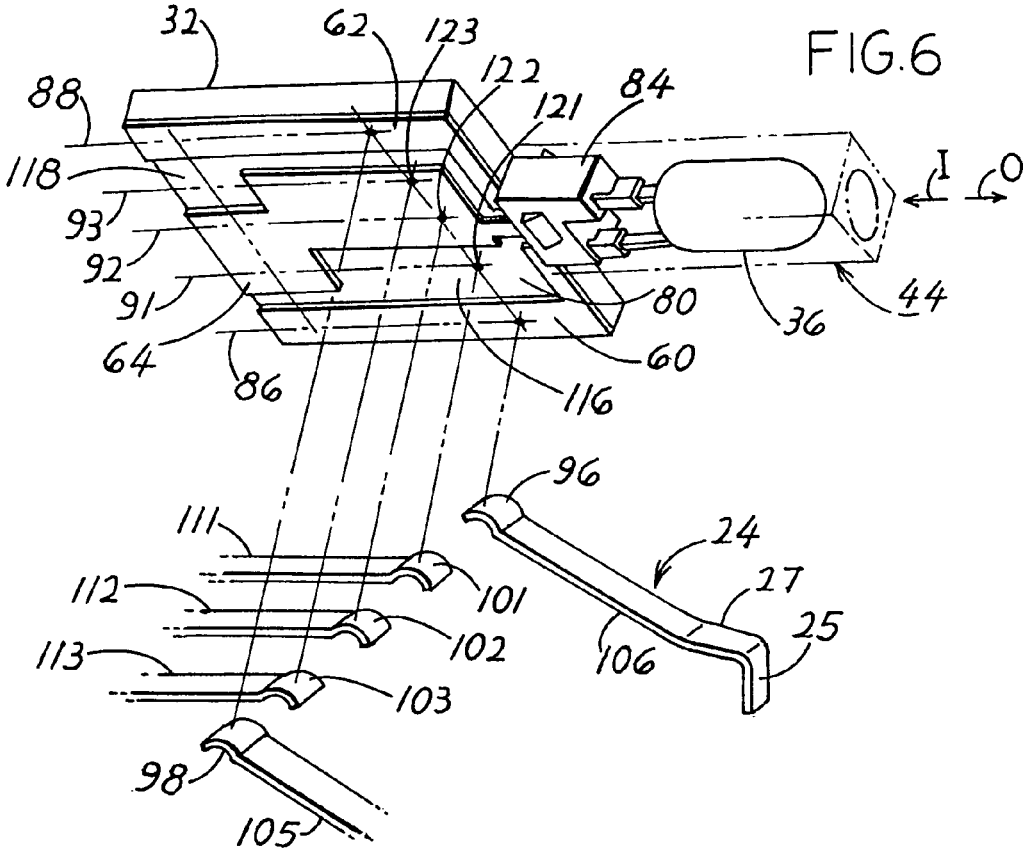
FIG. 6 is an exploded isometric view of a portion of the switch of FIG. 5, showing tracks on the frame that are engaged by deflectable portions of housing contacts.

FIG. 6 shows that the three pushbutton conductors 60–64 form five tracks, including two tracks 86, 88 on the two opposite lead conductors 60 and 64 that continually supply current to the LED, and three tracks 91–93 for the center pushbutton conductor 64. The two tracks 86, 88 are in continuous contact with two deflectable contact portions 96,98 of two housing contacts 106, 107. The three tracks 91–93 are in the paths of three deflectable switch contact portions 101–103 of three switching housing contacts 111–113. The pushbutton conductor 64 has an outward gap 116 at the outer end of the track 91. The pushbutton conductor has an inward gap 118 at the inward end of the track 93. The track 92 does not have any gaps along its length so it continually engages deflectable switch contact portion 102.

Figure 7:
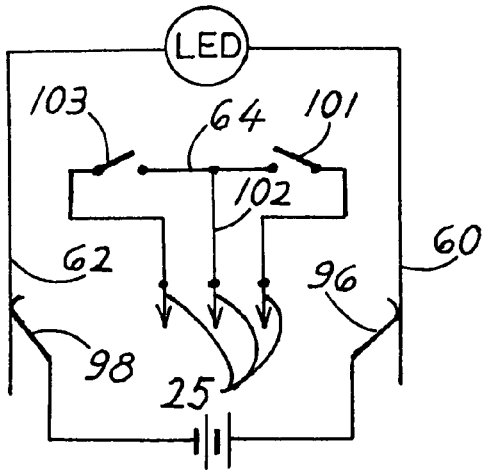
FIG. 7 is a schematic diagram showing how the conductors and contacts of FIG. 6 can be used.

When the pushbutton depressor element 44 is pushed inward I to move the pushbutton assembly to its inward position, the housing deflectable contact portions 101–103 press against points 121–123. One of the deflectable contact portions 101 engages the insulative contacting surface 80 at the gap 116. Thus, any circuit wherein current sometimes flows between the contact portions 102 and 101, is an open circuit. Similarly, When the pushbutton element is pushed in again and the pushbutton assembly moves to its outward position, the deflectable contact portion 103 engages the contacting surface 80 at the gap 118. FIG. 7 shows an electrical circuit representing the switch 10 of FIG. 6.

It would be possible to form the deflectable contact portions 96, 98 and 101–103 on the pushbutton conductors that are mounted on the slideable frame, instead of on contacts that are mounted on the housing. However, this would result in free deflectable contact portions that slide in and out. This would have the disadvantage that such in-and-out sliding deflectable contact portions could catch on something (e.g. an accidentally protruding part) and damage the switch, and would be more difficult to manufacture.

Figure 8:
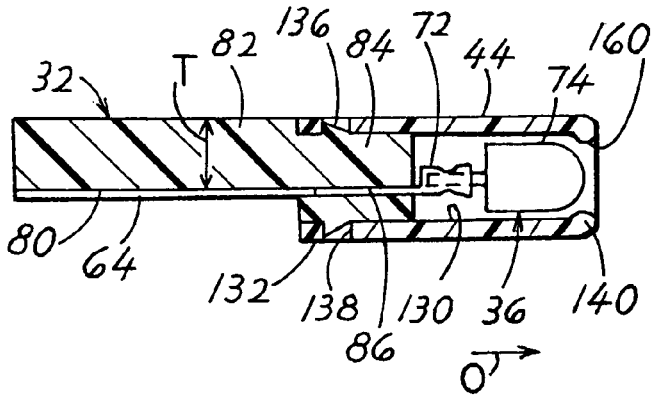
FIG. 8 is a sectional view taken on line 8—8 of FIG. 6.

FIG. 8 shows that the pushbutton depressor element 44 has a through passage 130 that receives the LED 36. An inward portion 132 of the passage walls is closely received in the outward extension 84 of the pushbutton frame, so there is substantially no tilt (no more that 3°) of the depressing element with respect to the frame. A pair of lugs 136 on the frame extension snap into holes 138 to lock the depressing element on the frame. The outer end portion 140 of the passage walls are constricted and project outward O of the LED bulb 74. This helps protect the bulb from heat that is applied during soldering of the switch 10 to the circuit board as is shown in FIG. 3.

Figure 9:
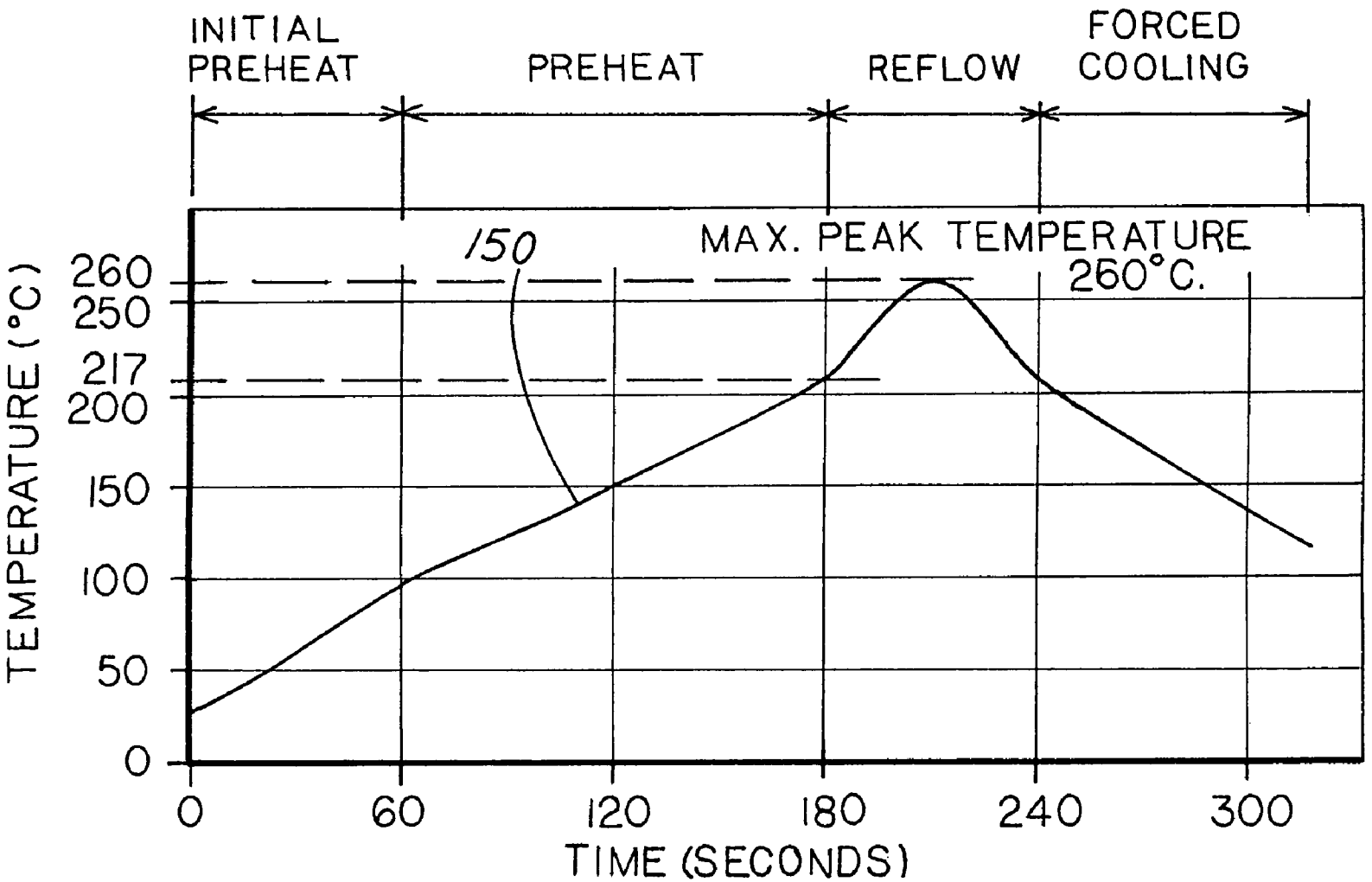
FIG. 9 is graph showing a typical temperature-time profile used in reflow soldering.

FIG. 9 contains a graph 150 that shows the temperature-time profile of the air temperature and of the temperature of the cover 16 and of the housing contact terminals that are all to be soldered (by a lead-free solder) to traces on the circuit board. The graph 150 shows the temperatures as the fully assembled switch passes through a reflow oven that heats solder preforms that have been applied to the locations where solder joints are to be formed. The solder is a lead-free composition that melts at about 250 C. The outer end portion 140 (FIG. 8) of the depressor element passage walls helps insulate the bulb 74 of the LED from the maximum heat applied to the solderable parts in the oven. The reduced diameter of the outer end 160 of the outer passage walls helps protect the bulb from damage, especially because there is no transparent window over the outer end. The fact that the inner end or portion 132 of the depressor element is blocked by the frame extension 84, prevents hot air from flowing through the passage of the depressor element, to thereby further reduce heating of the bulb. In the particular LED 36, the bulb could be damaged by heating it to 250° C.

Figure 2:
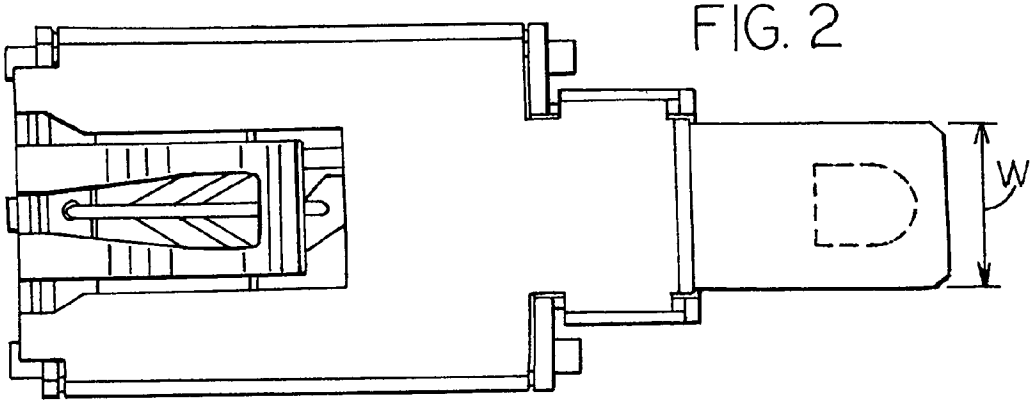
FIG. 2 is a plan view of the switch of FIG. 1.

In a switch of the construction shown that applicant has designed and constructed, the switch had an overall length A (FIGS. 2 and 3) of 28.5 millimeters between the outer end of the depressable element in its outward position, and the inward end of the housing cover. The depressable element had a width W of 6 mm and a height H of 4 mm.

Thus, the invention provides a circuit board-mountable, compact and low cost miniature illuminated pushbutton switch where the light source such as an LED, is mounted on a manually operable depressor element of the pushbutton assembly. A plurality of sheet metal fixed conductors mounted on a dielectric pushbutton frame, include two lead conductors fixed to the frame and fixed to two LED leads by crimping of rear ends of the conductors around the leads. The pushbutton frame has an inner portion of large width and small height, against which housing conductor resilient portions press. The frame has an offset outward extension, and the two lead conductors extend through a slit in the extension to their crimp locations. The depressor element has a passage that surrounds the LED, the passage having a front end of reduced diameter that lies forward of the bulb.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An illuminated pushbutton switch for soldering to a circuit board, which includes a housing, a pushbutton assembly that is slideable between inward and outward positions on the housing, and a spring that biases the pushbutton assembly outward, wherein:

said pushbutton assembly includes a dielectric pushbutton frame having a contacting surface, and a plurality of pushbutton conductors fixed to said frame and having portions lying on said contacting surface;

a plurality of housing contacts mounted on said housing and engageable with said pushbutton contacts, said housing contacts having terminal ends for soldering to said circuit board;

a light having a light-emitting bulb and having a pair of leads extending inward of said bulb;

said pushbutton conductors include a pair of pushbutton conductors that have outer portions each joined to one of said leads; and said pushbutton assembly includes a dielectric pushbutton depressing element having a through passage that surrounds said bulb, said depressing element having an inner end mounted on said pushbutton frame and having an outer end projecting outward of said bulb.

2. The switch described in claim 1 wherein:

said pushbutton frame includes a frame inner portion that forms said contacting surface;

said pushbutton conductors are formed of sheet metal and have conductor inner portions fixed to said contacting surface and have conductor outer portions that are crimped to said leads at locations within said depressing element.

3. The switch described in claim 2 wherein:

said conductor outer portions lie outward of said pushbutton frame and are bent around axes that extend in inward and outward directions.

4. The switch described in claim 1 wherein:

said pushbutton frame has a wide inner portion forming said contacting surface, and said pushbutton frame has a narrower outward extension that is closely surrounded by walls of said depressing element passage inner end portion to prevent said depressing element from tilting on said pushbutton frame, said outward extension having a pair of latch lugs, and said depressing element inner end having a pair of holes that each receives one of said latch lugs to fix said pushbutton element inner end to said pushbutton frame.

5. The switch described in claim 1 wherein:

said pushbutton conductors form a plurality of conductive tracks that are fixed to said pushbutton frame and that slide as said pushbutton frame slides;

said housing contacts have fixed contact portions fixed to said housing and have deflectable contact portions biased against said track paths;

said plurality of conductive tracks includes two conductive tracks formed on said pushbutton conductors and connected to said light source and in constant engagement with deflectable contact portions of first and second of said housing contacts;

said plurality of conductive tracks includes a first interrupted track that electrically engages a first of said deflectable contact portions in said pushbutton inward position but that has a gap location (118) that does not electrically engage said first deflectable contact portion in said pushbutton outward position;

said plurality of conductive tracks includes a second interrupted track that engages a second of said deflectable contact portions in said pushbutton outward position but that has a gap location (116) that does not electrically engage said second deflectable contact portion in said pushbutton inward position.

6. The switch described in claim 1 wherein:

said housing includes a dielectric main housing portion and a sheet metal cover, said housing contacts being mounted on said main housing portion, said sheet metal cover having tabs crimped to said main housing portion.

7. An illuminated pushbutton switch for soldering to a circuit board, which includes a housing, a pushbutton assembly that is slideable between inward and outward positions on the housing, and a spring that biases the pushbutton assembly outward, wherein:

said pushbutton assembly includes a dielectric pushbutton frame having a frame inner portion with a dielectric contacting surface and a plurality of pushbutton conductors having inner portions fixed to said contacting surface and moving inward and outward along paths as said pushbutton assembly moves inward and outward;

a plurality of deflectable contacts having fixed contact portions fixed to said housing and having terminal ends for soldering to said circuit board, said deflectable contacts having deflectable contact portions biased against the paths of different ones of said pushbutton conductors;

said pushbutton frame having an outward frame extension, a pair of said pushbutton conductors having middle portion extending through said frame extension, said pair of pushbutton conductors having outward ends that form a pair of crimp portions lying outward of said frame extension;

a light having a light-emitting bulb lying outward of said crimp portions and having a pair of leads extending inward of said bulb, said pair of crimp portions each crimped around one of said leads;

a dielectric pushbutton element having a through passage that surrounds said bulb, said pushbutton element having an inner end mounted on said pushbutton frame and having an outer end projecting outward of said bulb.

8. The illuminated pushbutton switch described in claim 7 wherein:

said through passage of said dielectric pushbutton element has an outer passage portion that is of smaller diameter than said bulb so said bulb cannot pass therethrough.

9. A method for constructing an illuminated pushbutton switch for soldering to a circuit board, the switch including a housing, a plurality of housing conductors mounted on the housing, and a pushbutton assembly that is slideable in inward and outward directions on the housing, the pushbutton assembly including a dielectric pushbutton frame and a plurality of pushbutton conductors mounted on said pushbutton frame and in sliding engagement with said housing conductors, and a light having a light-emitting bulb and a pair of light leads engaged with a pair of said pushbutton conductors, including:

forming said pair of pushbutton conductors of sheet metal with outer ends formed as crimp barrels;

crimping said crimp barrels around said light leads;

sliding a dielectric pushbutton element that has a through passage around said light so said bulb is received in said passage, and latching an inner end of said pushbutton element to said pushbutton frame, with an outer end of said pushbutton element extending outward of an outer end of said bulb.

10. The method described in claim 9 including:

placing said housing on a circuit board that has conductive traces and heating the housing and circuit board to solder contacts on said housing to said traces, said step of heating including placing said housing in an environment of more than 225° C. for no longer than one minute, so walls of said pushbutton element reduce heating of said bulb.

* * * * *